US008971547B2

(12) United States Patent
Button

(10) Patent No.: US 8,971,547 B2
(45) Date of Patent: Mar. 3, 2015

(54) PASSIVE GROUP DELAY BEAM FORMING

(75) Inventor: Doug Button, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 88 days.

(21) Appl. No.: 12/684,598

(22) Filed: Jan. 8, 2010

(65) Prior Publication Data

US 2013/0336505 A1 Dec. 19, 2013

Related U.S. Application Data

(60) Provisional application No. 61/143,336, filed on Jan. 8, 2009.

(51) Int. Cl.

| | |
|---|---|
| ***H04R 3/00*** | (2006.01) |
| ***H04R 1/02*** | (2006.01) |
| ***H04S 7/00*** | (2006.01) |
| ***H04R 3/12*** | (2006.01) |

(52) U.S. Cl.
CPC ... *H04S 7/30* (2013.01); *H04R 3/12* (2013.01)
USPC ..... 381/92; 381/87; 381/89

(58) Field of Classification Search
CPC ..... H04R 1/323; H04R 1/32; H04R 1/403; H04R 1/40
USPC ..... 381/92, 303, 59, 87, 89, 332, 334
See application file for complete search history.

(56) References Cited

U.S. PATENT DOCUMENTS

| | | | | |
|---|---|---|---|---|
| 1,643,323 A | | 9/1927 | Stone | |
| 3,068,431 A | * | 12/1962 | Watts, Jr. | 333/156 |
| 3,125,181 A | | 3/1964 | Pawlowski | |
| 3,299,206 A | | 1/1967 | Klepper | |
| 4,015,089 A | * | 3/1977 | Ishii et al. | 381/89 |
| 4,330,691 A | * | 5/1982 | Gordon | 381/335 |
| 4,845,759 A | | 7/1989 | Danley | |
| 5,233,664 A | | 8/1993 | Yanagawa et al. | |
| 6,128,395 A | | 10/2000 | De Vries | |

(Continued)

FOREIGN PATENT DOCUMENTS

| | | |
|---|---|---|
| EP | 0 065 810 A2 | 1/1982 |
| WO | WO 02/071796 A1 | 9/2002 |

OTHER PUBLICATIONS

European Search Report dated Feb. 1, 2013, pp. 1-9, European Patent Application No. 10 151 410.7-1224 / 2247120, European Patent Office, Rijswijk, Netherlands.

(Continued)

*Primary Examiner* — Vivian Chin
*Assistant Examiner* — Douglas Suthers
(74) *Attorney, Agent, or Firm* — Alleman Hall McCoy Russell & Tuttle LLP

(57) ABSTRACT

A loudspeaker array and methods for generating sound in an arc pattern. The loudspeaker array includes a plurality of loudspeakers. A delay network is included, the delay network having a plurality of stages. Each stage has a stage input and a stage output. The stage output of each stage is coupled to the stage input of a next stage. Each stage output is also connected to at least one of the plurality of loudspeakers. The stage input of the first stage is coupled to an audio signal input. Each stage is configured to add an electrical delay of the audio signal at each subsequent stage. The electrical delay is adjusted such that the plurality of loudspeakers generates sound in a desired radiation pattern.

14 Claims, 8 Drawing Sheets

(56) References Cited

U.S. PATENT DOCUMENTS

| | | | | |
|---|---|---|---|---|
| 6,584,202 | B1 * | 6/2003 | Montag et al. | 381/63 |
| 7,260,235 | B1 | 8/2007 | Henricksen et al. | |
| 2002/0131608 | A1 * | 9/2002 | Lobb et al. | 381/111 |
| 2004/0240697 | A1 * | 12/2004 | Keele, Jr. | 381/336 |
| 2008/0212805 | A1 | 9/2008 | Fincham | |

OTHER PUBLICATIONS

JBL Professional, "CBT Constant Beamwidth Technology", Technical Notes vol. 1, No. 35, Oct. 2009, 22 pgs.

Novak, James; A Column Loudspeaker With Controlled Coverage Angle; Chicago, IL; May 25, 1962.

Keele, Jr., D. B.; Implementation of Straight-line and Flat-Panel Constant Beamwidth Transducer (CBT) Loudspeaker Arrays Using Signal Delays; Audio Engineering Society; Convention Paper; Los Angeles, CA; Oct. 5-8, 2002.

Keele, Jr., D. B.; Implementation of Straight-line and Flat-Panel Constant Beamwidth Transducer (CBT) Loudspeaker Arrays Using Signal Delays; Audio Engineering Society; Convention Paper 5653; Los Angeles, CA; Oct. 5-8, 2002.

Klepper, David L and Steele, Douglas W.; Constant Directional Characteristics from a Line Source Array; Cambridge Massachusetts; Journal of the Audio Engineering Society; Jul. 1963; vol. 11, No. 3.

Rhombus Industries Inc., "Delay Lines, Passive & Logic Buffered", Jun. 2001, 30 pages.

European Patent Office, Summons to Attend Oral Proceedings Pursuant to Rule 115(1) EPC, Dec. 9, 2014, Germany, 6 pages.

* cited by examiner

PASSIVE GROUP DELAY BEAM FORMING

BACKGROUND OF THE INVENTION

1. Field of the Invention

The invention relates to audio wideband beam steering or forming from multiple sources, and in particular to beam forming by passive group delay.

2. Related Art

Loudspeaker systems have been implemented as arrays of loudspeakers, or drivers; either stacked and aligned vertically, aligned horizontally, or in two dimensions. The drivers in such configurations may be of the same type, such as tweeters, midrange speakers, or wideband speakers. The drivers may also be connected to cross-over networks, or filters to generate sound in particular frequency ranges.

One problem with loudspeaker systems arranged in an array is that the sound generated by multiple drivers does not create a consistent sound field or pattern. This inconsistency in the sound field or pattern distorts the sound and impairs the listening experience of the listener.

One solution to the problem is to utilize a digital delay to effectively move the apparent sound from a driver in the array by introducing time delay creating a more consistent coverage. Another solution involves physically placing each driver appropriately in space to create a more consistent sound field. In either solution, the drivers are generally arranged in an arc or spherical shape either through time delay or, physically placed to form an arc or sphere, to provide a desired coverage.

A constant beam width transducer (CBT) is a type of sound transducer designed to provide a listening area with a sound beam that projects at a constant angle. The source of sound projects substantially at an angle and forms the listening area within the space defined by the angle sides. One design goal is for CBT's to project the sound at the same frequency response and volume at any point along any arc of points equidistant to the source. A CBT's beamwidth is defined as an angle. Studies of CBTs show that a curved line array or spherical array will have a constant beam width of approximately 66% of the total physical arc. The CBT also requires that the elements in the array be 'shaded.' That is, the drivers in the center are loudest, and the speakers on either side are attenuated more and more along the arc towards the ends of the array. The time delay or physical curving creates the coverage pattern and the shading smoothes the on- and off-axis response. By using time delay, the arc or sphere can be created from a straight line or flat 2-D array, respectively. This is often preferable for esthetic and space reasons. However providing a separate amp channel and associated digital time delay for each device can be expensive.

It would be desirable to provide an arc coverage pattern using a straight or flat speaker array without the need for expensive digital time delay circuitry.

SUMMARY

In view of the above, a loudspeaker array is provided. The loudspeaker array includes a plurality of loudspeakers. A delay network is included, the delay network having a plurality of stages. Each stage has a stage input and a stage output. The stage output of each stage is coupled to the stage input of a next stage. Each stage output is also connected to at least one of the plurality of loudspeakers. The stage input of the first stage is coupled to an audio signal input. Each stage is configured to add an electrical delay of the audio signal at each subsequent stage. The electrical delay is adjusted such that the plurality of loudspeakers generates sound in a desired radiation pattern.

A method is also provided for creating a radiation pattern using a linear loudspeaker array. In an example method, the positions of the loudspeakers in the linear array are set. A delay network is formed by connecting a plurality of delay stages in a ladder configuration. A middle loudspeaker positioned closest to a center of the linear array is connected to the audio signal input. A first loudspeaker pair of loudspeakers positioned on opposite sides of the center of the linear array is connected in series and the pair is connected in parallel with the stage output. Each succeeding loudspeaker pair of loudspeakers positioned on opposite sides of the center of the linear array is connected in series with each other and each succeeding pair is connected in parallel with each succeeding stage output. The component values of components in the delay stages are adjusted to delay propagation of the audio signal through the stage by a predetermined time.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The description of examples implementations that follows may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
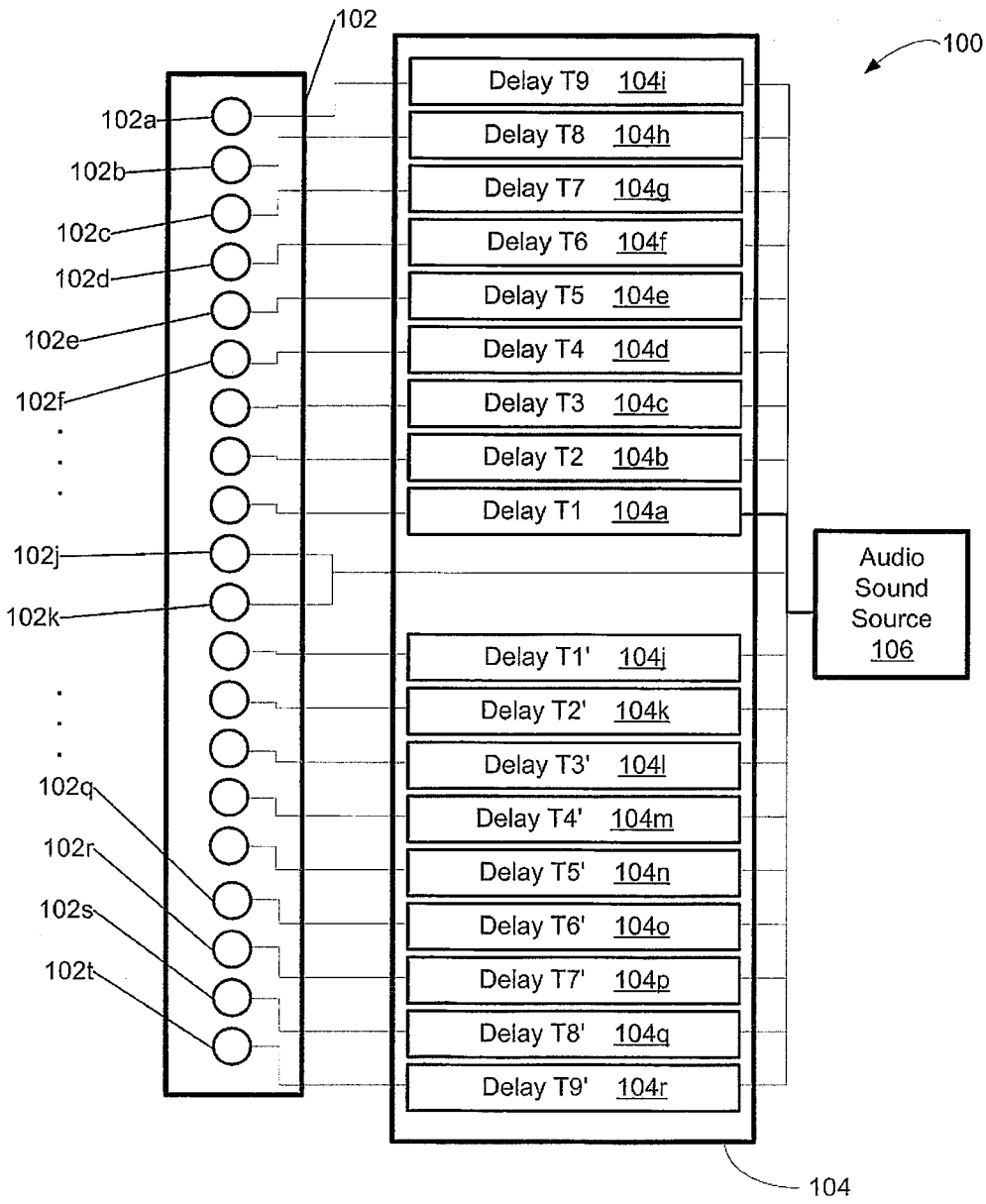
FIG. 1 is a block diagram of an example audio system having a loudspeaker array using a delay network.

FIG. 1 is a block diagram of an example audio system 100 having a loudspeaker array 102 using a delay network 104. The system 100 includes an audio sound source 106, such as the audio output of an entertainment system for music and/or multi-media. The loudspeaker array 102 includes a plurality of drivers **102*a*-102*t* aligned vertically. The loudspeaker array 102 may include any number of speakers. Twenty drivers are shown in the loudspeaker array 102 in FIG. 1. The drivers 102***a*-102*t* are aligned vertically in FIG. 1. However, the loudspeaker array 102 is not limited to any particular linear orientation. In addition, the drivers 102*a*-102*t* are aligned linearly along at least one direction, such as vertical, horizontal or diagonal, when viewed from directly in front of the loudspeaker array 102 as shown in FIG. 1. When viewed from the side for a vertically arranged array 102 or from above for a horizontally arranged array 102, the drivers 102*a*-102*t* in the loudspeaker array 102 may be linearly arranged to form a straight line array. The drivers 102*a*-102*t* may be arranged along a curve to form a curved line array. The drivers 102*a*-102*t* may be partially linearly arranged and partially arranged along a curve. The loudspeaker array 102 may include drivers 102*a*-102*t* configured to generate a sound beam having any shape according to the distribution of the drivers 102*a*-102*t* and direction of projection. The loudspeaker array 102 may also be configured to generate a sound beam having a constant beam width along at least one of its linear dimensions by adjusting the delay and attenuation characteristics as described below with reference to FIGS. 2-8.

The drivers 102*a*-102*t* may be drivers of any type. For example, the drivers 102*a*-102*t* may be tweeters for generating high frequency audio, woofers for generating low frequency audio, or midrange speakers for generating mid-range frequency audio. Crossover networks may be connected to the delay network 104, which may be configured to distribute the audio signals to the appropriate drivers (for example, low frequency signals to woofers, high frequency signals to tweeters, and midrange signals to midrange drivers). The drivers 102*a*-102*t* may also be full-range drivers, each able to drive audio through the entire specified range.

Example loudspeaker arrays and delay networks are described below in which the loudspeaker arrays include any number of full-range drivers. The size of the drivers used may be selected according to the wavelength of the upper limit of the frequencies of the sound being generated. The drivers are separated by a distance preferably less than one wavelength of the highest frequency.

The delay network 104 is connected to the loudspeaker array 102 as described in more detail below with reference to FIGS. 2 and 3. The delay network 104 includes a plurality of delay units, or stages, 104*a*-104*r*, configured to generate delays in the signals being coupled to the drivers 102*a*-102*t* in the loudspeaker array 102. The delay units 104*a*-104*r* in FIG. 1 generate delays that increase for the drivers 102*a*-102*t* from the center of the array to the outside of the array. For example, no delay at all is applied to the signal coupled to the center drivers 102*j*-102*k*. A delay of nT and nT' is inserted in the signal coupled to each driver on either side of the center drivers 102*j*, 102*k*. The largest delay is inserted into the signal coupled to the drivers on the top 102*a* and bottom 102*t* of the array. The components in the delay units 104*a*-104*r* that generate the delay for each driver 102*a*-102*t* are passive components, which include components that do not require a power source for operation, such as for example, inductors, capacitors, and/or resistors. The passive components in the delay network 104 may be selected to generate a flat group delay with frequency such that the loudspeaker array 102 generates sound as though the drivers 102*a*-102*t* were arranged physically or configured with digital delay to provide coverage of a constant beam transducer ("CBT"). In the examples described below, inductors and capacitors are arranged in a cascaded ladder circuit with values selected to provide the desired progressive delay. The delay units 104*a*-104*r* described with reference to FIGS. 1-4 are implemented using passive components, but may also be implemented using delay units that include active components, such as transistors, integrated circuits, etc.

It is noted that the description below describes examples of delay networks in which the delay units (such as delay units 104*a*-104*r*) are applied symmetrically about the center drivers (such as center drivers 102*j* and 102*k*). That is, the delays generated by each delay unit are equal and the delay network is configured to increment the sum of delays at each driver positioned away from the center drivers. In other examples, the delay network 104 need not be symmetrical. Each delay unit in the delay network may have a unique delay value and different attenuation characteristics that a designer may configure to generate a desired constant beam width pattern.

Figure 2:
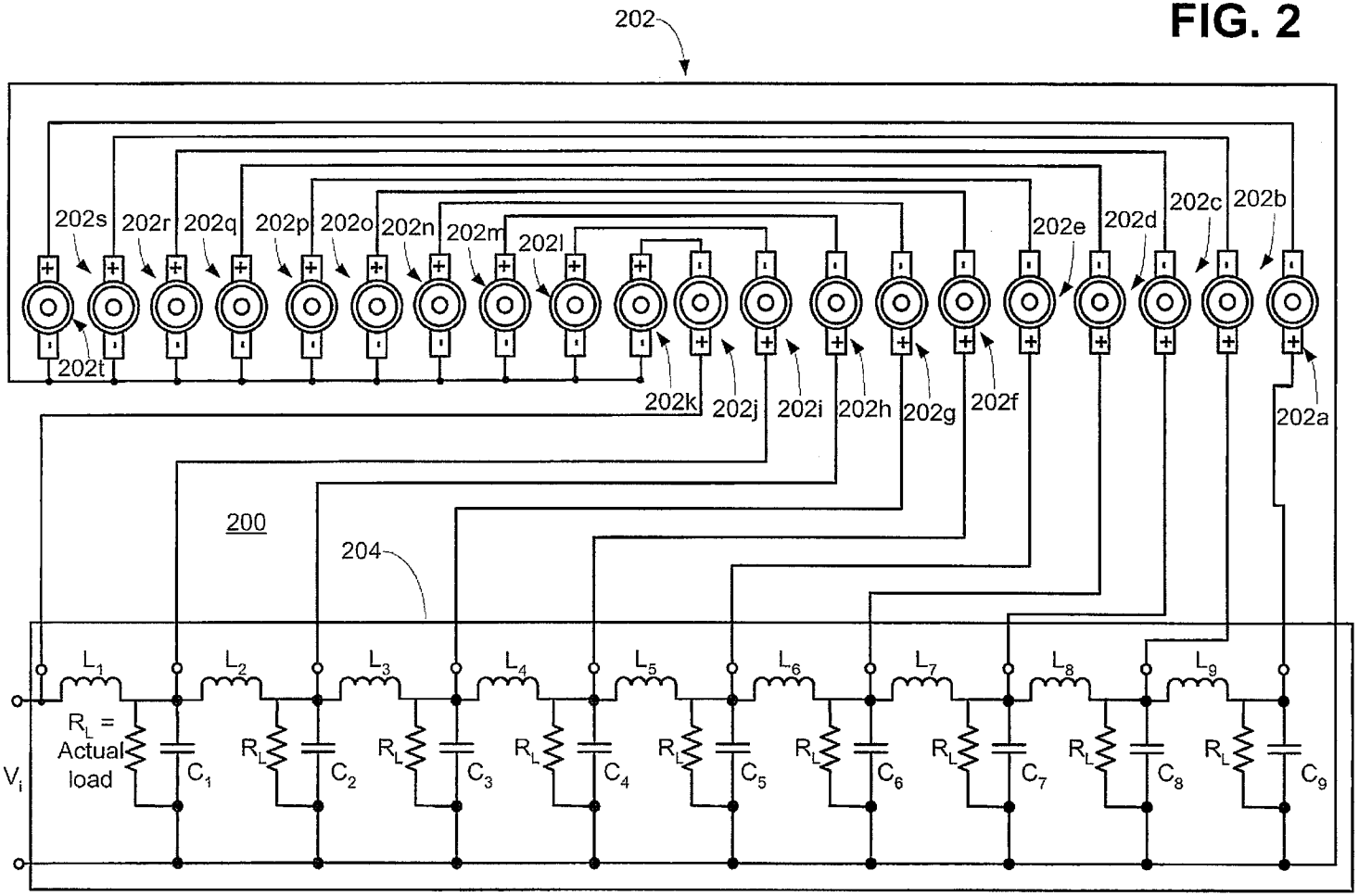
FIG. 2 is a schematic diagram of an example of the loudspeaker array and delay network in FIG. 1.
Figure 3:
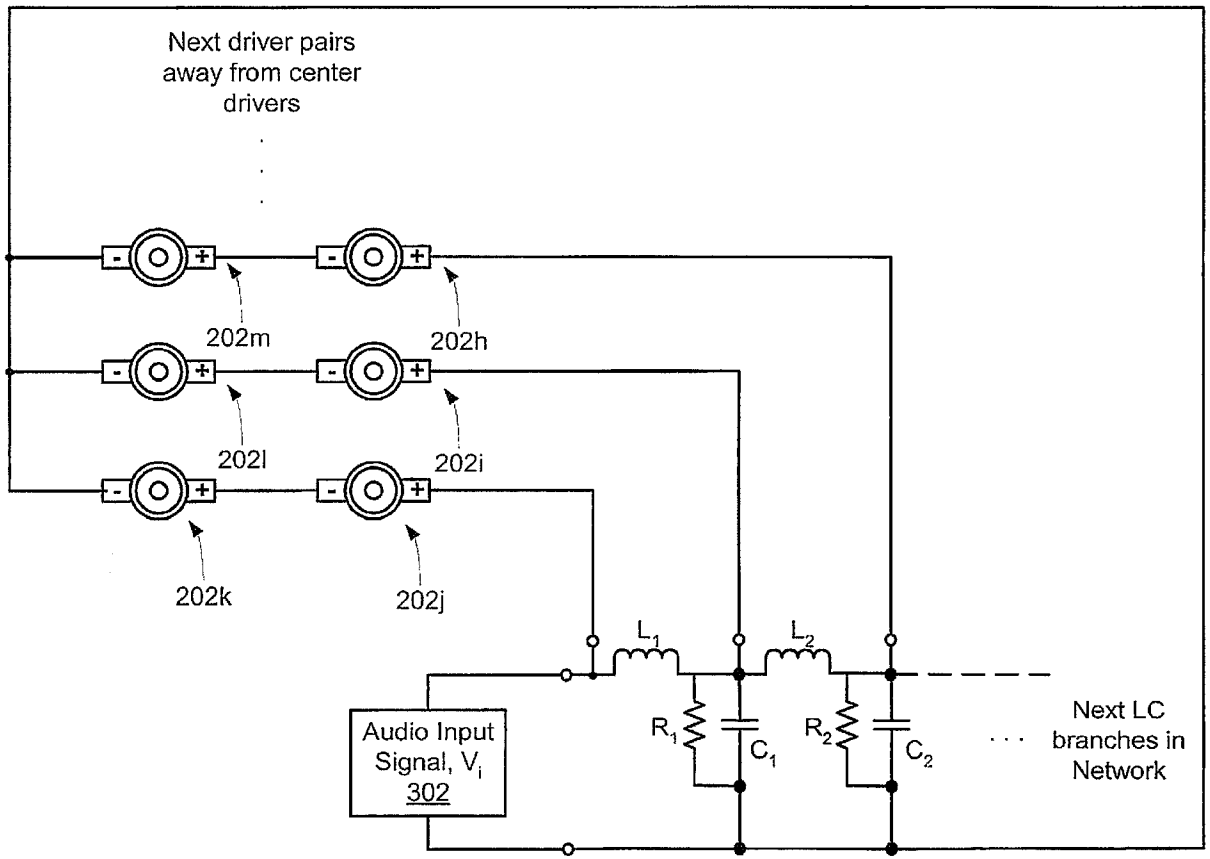
FIG. 3 is a schematic diagram of several driver pairs connected to corresponding LC branches from the delay network in FIG. 2.

FIG. 2 is a schematic diagram of an example of the loudspeaker array and delay network in FIG. 1. The example 200 in FIG. 2 includes a 20-element loudspeaker array 202 and a cascaded LC ladder network ("ladder network") 204, which is one example of the delay network 104 shown in FIG. 1. The loudspeaker array 202 includes 20 drivers 202*a*-202*t* arranged linearly. The configuration in FIG. 2 is horizontal, however, a vertical configuration may be used as well.

Assuming a horizontal configuration, the driver 202*a* is located on one end of the array. The remaining drivers 202*b*-202*t* are then aligned in order such that the driver 202*t* is on the opposite end of the driver 202*a*. The driver pair of driver 202*j* and 202*k* (center drivers 202*j*, 202*k*) is positioned at the center of the loudspeaker array 202.

Assuming a vertical configuration, the driver 202*a* is positioned at the top of the loudspeaker array 202 and the driver 202*t* is positioned at the bottom of the loudspeaker array 202. The center drivers 202*j*, 202*k* are positioned in the middle of the vertical loudspeaker array 202. In the description that follows, a vertical configuration is assumed. However, examples of the described implementations are not limited to vertical configurations.

The ladder network 204 is connected to an input signal $V_i$. The ladder network 204 includes delay units, or stages, formed with inductors $L_1$-$L_9$ and capacitors $C_1$-$C_9$ connected to form a cascaded ladder of LC branches with taps used to connect to the drivers 202*a*-202*t* in the loudspeaker array 202. Each stage includes a stage input and a stage output. The stages are configured such that the inductors $L_1$-$L_9$ are connected in series with the input signal $V_i$ and the capacitors $C_1$-$C_9$ are connected in parallel with pairs of drivers between the inductors. The stage output for each stage in the ladder network 204 in FIG. 2 is the stage input for the next stage in the ladder network 204. The stage output for the first stage is the stage input for the second stage. The stage output for the second stage is the stage input for the third stage. As shown in FIG. 2, each capacitor in the LC branches forming the stages connects to the node between each inductor. The taps to the ladder network 204 are at each stage output, which is the node connecting the capacitor between the inductors. The values of the inductors $L_1$-$L_9$ and capacitors $C_1$-$C_9$ are selected to insert the appropriate delay to the signal being coupled to the corresponding drivers. The ladder network 204 includes a load resistance $R_L$ representing the load resistance of two drivers connected in series.

Figure 4:
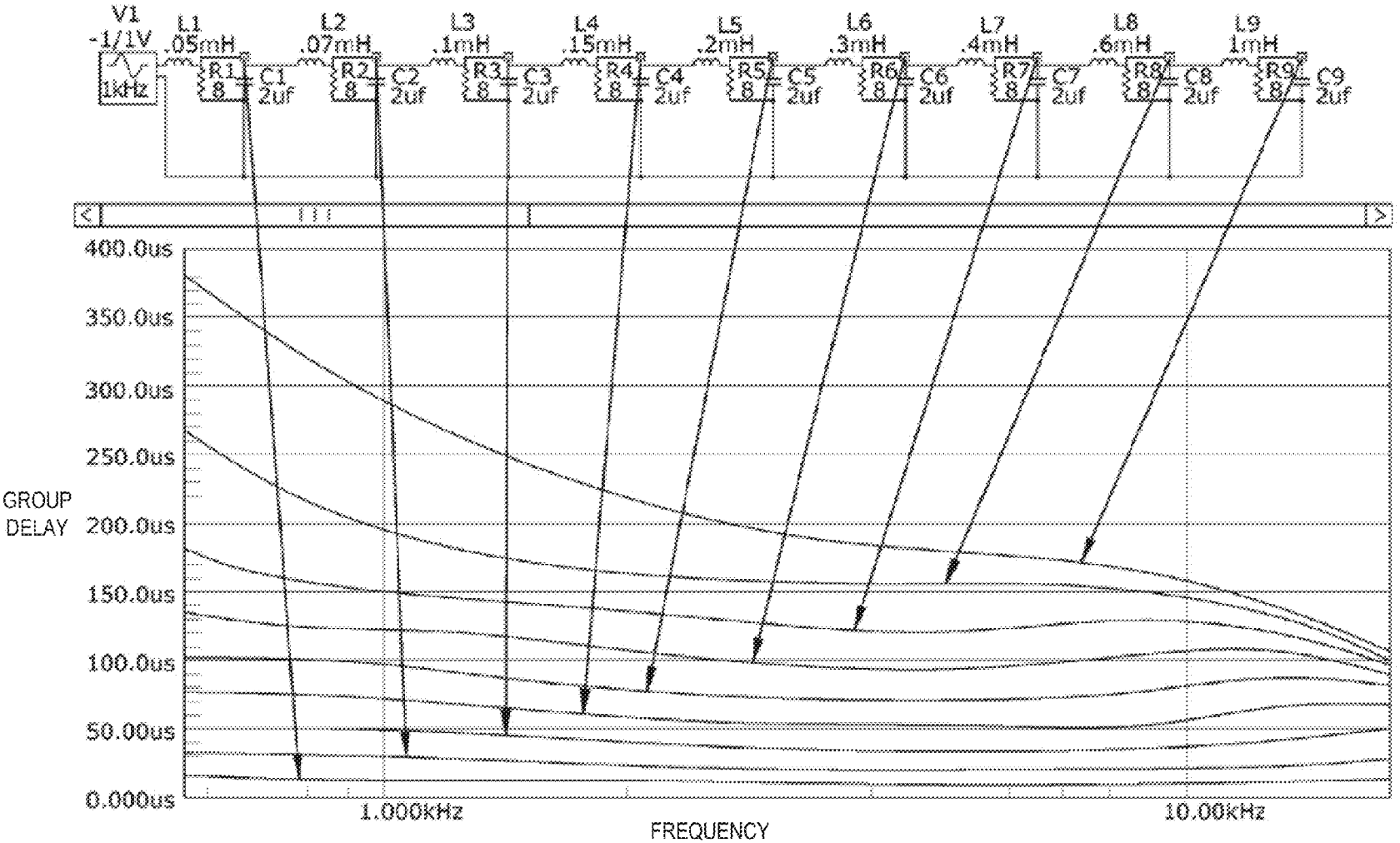
FIG. 4 is a graph illustrating the group delay versus frequency at each driver pair in the loudspeaker array in FIG. 2.
Figure 5:
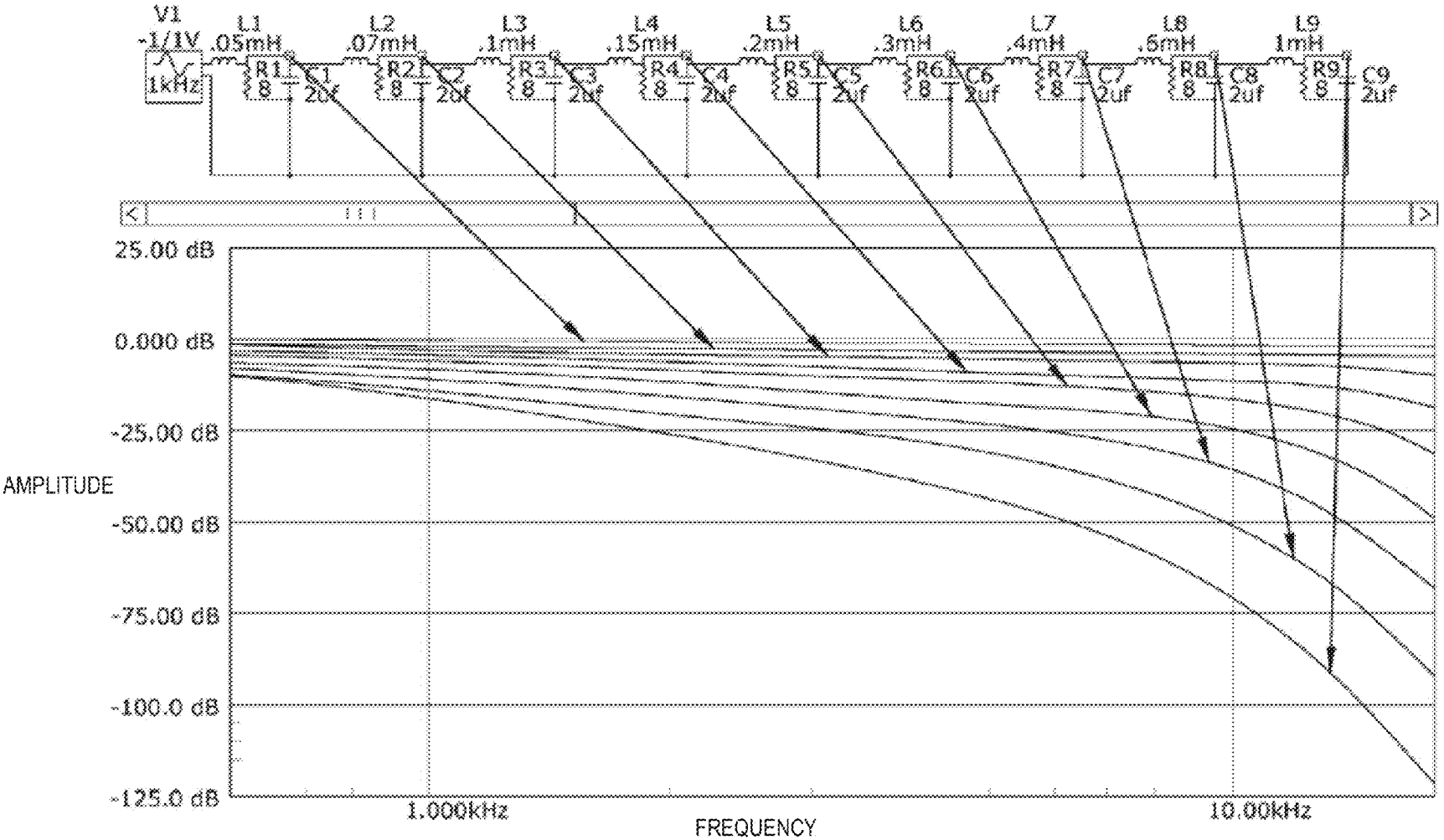
FIG. 5 is a graph illustrating the transfer function shading of drivers in the loudspeaker array in FIG. 2.

The configuration of the stages in FIG. 2 is recognizable to those of ordinary skill in the art to be a low pass filter. While the topology is the same as a low pass filter, the values of the components are radically different. The component values are mistuned. That is, the component values are sized to create flat group delay with frequency, which is not done with low pass filters. The component values are also sized to create relatively flat attenuation over a broad frequency range. As shown in FIG. 5, the first 4 or 5 transfer functions (from the center out) are flat. The group delay along the ladder is cumulative as is seen in FIG. 4.

The taps to the ladder network 204 are connected to the drivers 202*a*-202*t* such that the shortest delays are provided to the signals coupled to the drivers in the center of the array and the delays increasing to the signals coupled to the drivers extending up and down from the center drivers 202*j*, 202*k*. The drivers 202*a*-202*t* are driven in driver pairs physically positioned symmetrically about the center of the loudspeaker array 202. In the example shown in FIG. 2, the center drivers 202*j*, 202*k* are positioned vertically at the center of the array. The next driver pair 202*i*, 2021 are arranged with driver 202*i* positioned above center driver 202*j* and driver 202*l* positioned below center driver 202*k*. The subsequent driver pairs are arranged similarly from the center to the top and bottom. The driver pairs are connected to the ladder network 204 such that the signal is coupled to one terminal (for example, the '+' terminal) of one driver in the pair. The other terminal (for example, the '−' terminal) is connected to a terminal (for example, the '+' terminal) of the other driver in the driver pair. The opposite terminal (for example, the '−' terminal) of the other driver in the driver pair is connected to a common connection that connects one terminal of half of the drivers in the array 202. That is, the common connection connects one terminal of the other driver in each driver pair. An opposite terminal of the driver pair is connected to the ladder network 204 to receive the delayed signal.

As shown in FIG. 2, the center drivers 202*j*, 202*k* are connected to the audio signal input $V_i$ such that the audio signal coupled to the center driver pair 202*j*, 202*k* is not delayed. The LC branch formed with inductor $L_1$ and capacitor $C_1$ provides the first delay, which is inserted to the signal coupled to the first driver pair 202*i*, 202*l*. The LC branch formed with inductor $L_2$ and capacitor $C_2$ provides the second delay, which is added to the first delay and inserted to the signal coupled to the second driver pair 202*h*, 202*m*. Each succeeding branch formed by inductors $L_3$-$L_9$ and capacitor $C_1$-$C_9$ provides a progressively greater delay to each succeeding driver pair such that the delay is increasing for the drivers closest to the top and bottom. Effectively, each driver pair (top and bottom) of transducers is tapped off the ladder at further increments in group delay so the outside transducers receive delay from all sections of the ladder thereby receiving the greatest delay. The group delay yields an apparent curving of the array in the vertical dimension.

FIG. 3 is a schematic diagram of several driver pairs connected to corresponding stages formed by the LC branches in the delay network in FIG. 2. FIG. 3 shows the center driver pair 202*j*, 202*k*; the next driver pair 202*i*, 202*l* after the center driver pair 202*j*, 202*k*; and the next driver pair 202*h*, 202*m* after the previous driver pair 202*i*, 202*l*. The ladder network includes the first stage formed with the LC branch of inductor $L_1$ and capacitor $C_1$; and the second stage formed with the LC branch of inductor $L_2$ and capacitor $C_2$. Each stage of the ladder network includes a load resistance (e.g., $R_1$ and $R_2$) representing the load resistance of the driver pairs connected to that stage. The succeeding LC branches are not shown for purposes of providing clarity of the description but could continue ad infinitum.

The ladder network includes an audio input signal generator 302 coupled to the input of the ladder network. As shown in FIG. 3, the first tap in the ladder network connects directly to the first driver pair 202*j*, 202*k*. The first driver pair 202*j*, 202*k* is the center driver pair, which receives the audio signal without delay. The second tap in the ladder network between inductor $L_1$ and inductor $L_2$ is connected to the second driver pair 202*i*, 202*l*. The first driver 202*i* in the second driver pair receives the delay and signal attenuation provided by the first LC branch formed by inductor $L_1$ and $C_1$. Thus, the first delay is inserted to the signal coupled to the first driver on top of the center driver 202*j*, which is driver 202*i*; and to the first driver below the center driver 202*k*, which is driver 202*l*. The third tap in the ladder network between inductor $L_2$ and inductor $L_3$ is connected to the third driver pair 202*h*, 202*m*. The first driver 202*h* in the third driver pair receives the delay and signal attenuation provided by both the first LC branch formed by inductor $L_1$ and $C_1$ and the second LC branch formed by inductor $L_2$ and $C_2$. Thus, the second delay is inserted to the signal coupled to the second driver on top of the center driver 202*j*, which is driver 202*h*; and to the second driver below the center driver 202*k*, which is driver 202*i*.

In addition to the group delay being inserted at the signal coupled to each driver pair, the signal is progressively attenuated. The signal received by the drivers at the ends is attenuated relative to the signal at the center drivers 202*j*, 202*k*.

The graphs in FIGS. 4 and 5 illustrate the group delay and magnitude attenuation provided by an example ladder network 204. These two effects of the ladder network 204 operate similar to the CBT concept with time delay and amplitude shading creating a constant width coverage beam at frequencies in which the wave length is smaller than the size of the array.

FIG. 4 is a graph illustrating the group delay versus frequency at each driver pair in the loudspeaker array in FIG. 2. Each curve in the graph represents the delay inserted at the signal at each tap in the ladder network 204 through the frequency range of operation. As shown in FIG. 4, the delay is increasingly greater at each successive tap starting from the tap at the audio signal input, which is connected to the center drivers 202*j*, 202*k*. The delay is longest at the tap after the LC branch formed by inductor $L_9$ and capacitor $C_9$, which connect to the drivers at the top (at 202*a*) and bottom (at 202*t*) of the loudspeaker array.

FIG. 5 is a graph illustrating shading of drivers in the loudspeaker array in FIG. 2. Each curve in the graph in FIG. 5 represents the amplitude at each tap in the ladder network 204 through the frequency range of operation. As shown in FIG. 5, the signal is increasingly attenuated at each successive tap starting from the tap at the audio signal input, which is connected to the center drivers 202*j*, 202*k*.

Figure 6:
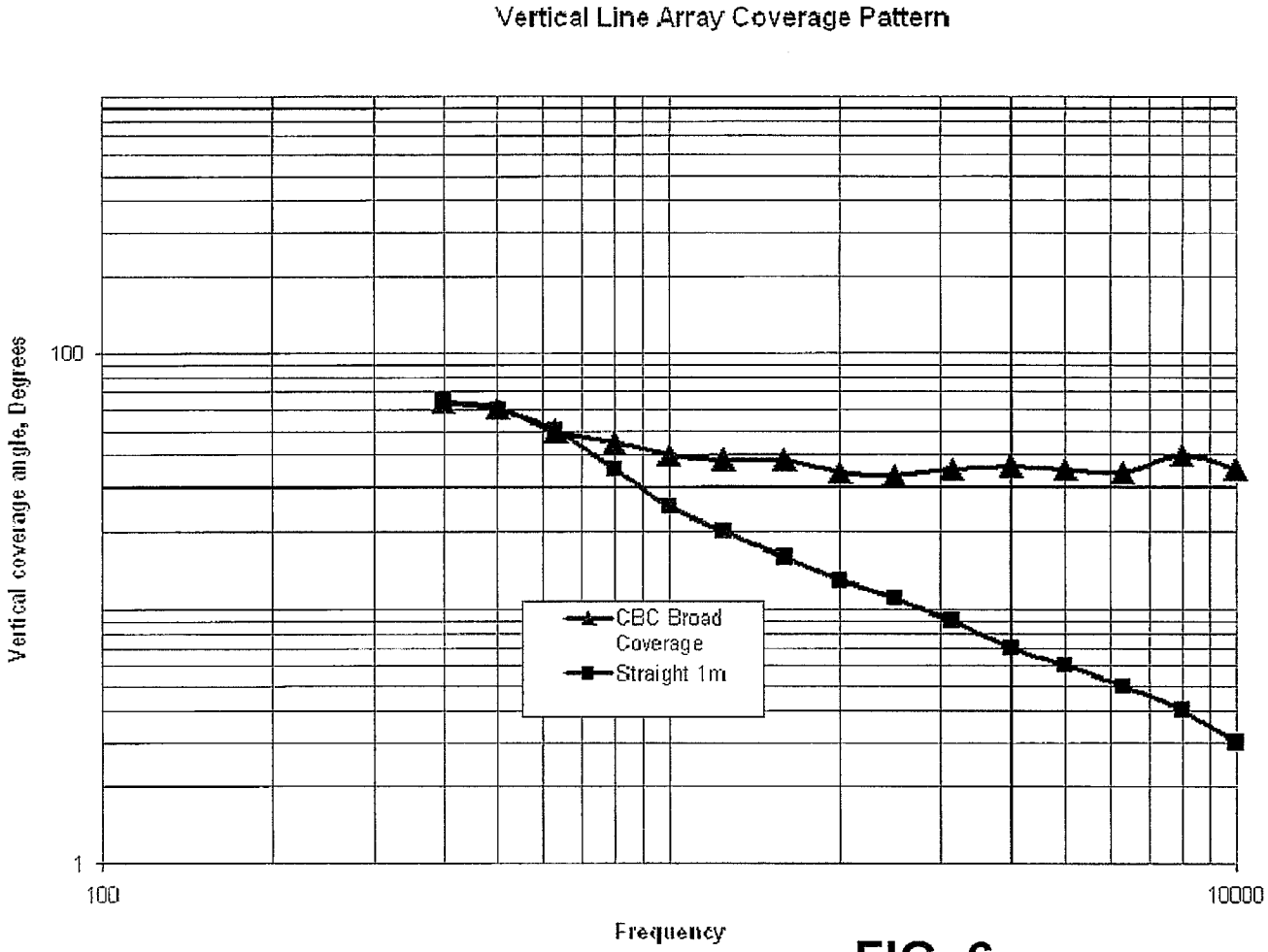
FIG. 6 is the vertical beamwidth of a group delay shaded array versus a straight line array of 16 elements.

FIG. 6 is a graph illustrating the beamwidth versus frequency for a group delay derived array versus straight line array. The graphs are beamwidth plots for a 16-element array of one meter high. The graph for the group delay derived array shows beamwidth for a group delay derived with a broad vertical beam of 40 degrees (above 800 Hz).

Figure 7:
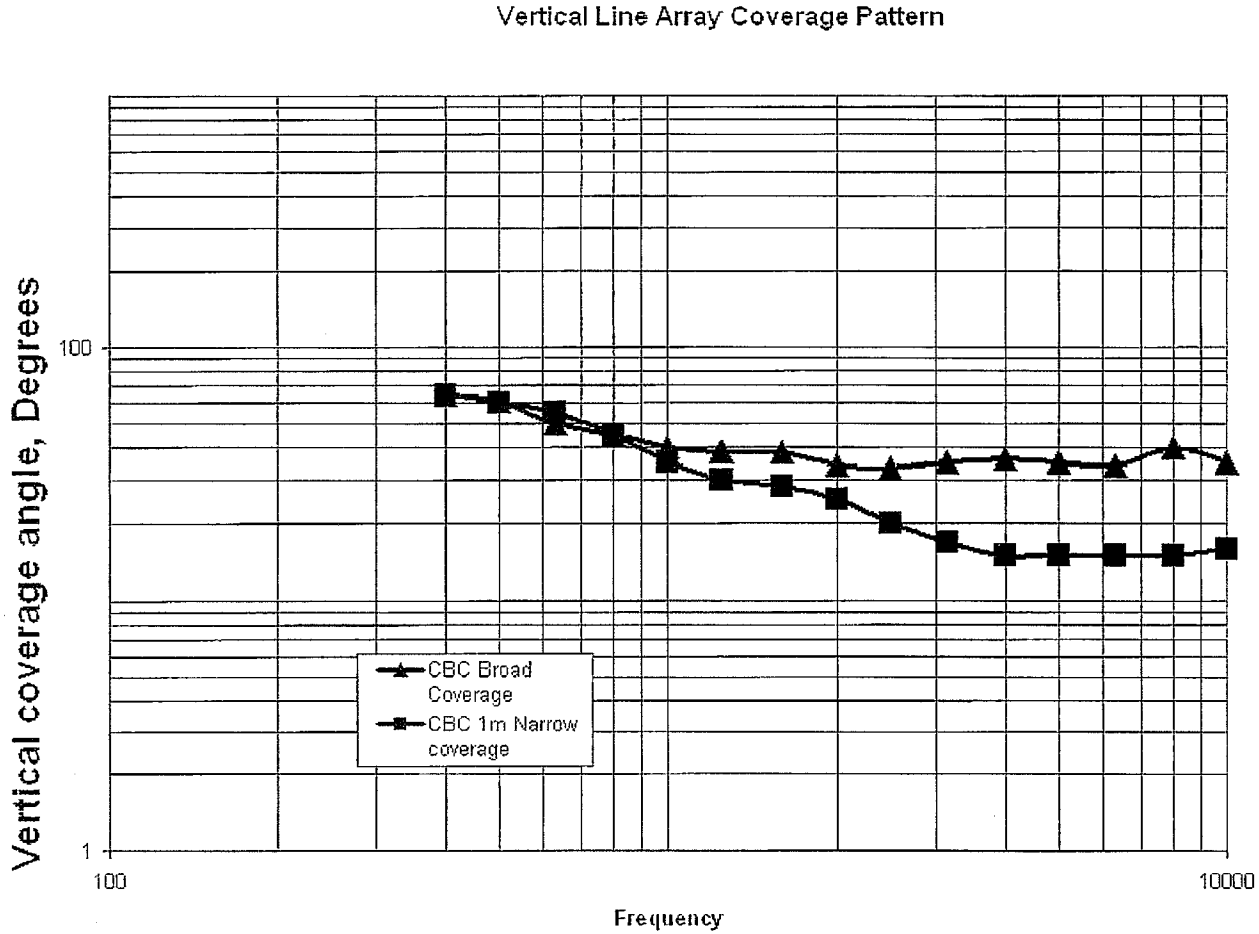
FIG. 7 is a graph illustrating the beamwidth versus frequency for 2 different arrays of 16 elements of the same size, the arrays having delay networks with different component values.

FIG. 7 is a graph illustrating the beamwidth versus frequency for 2 different arrays of 16 elements of the same size, the arrays having delay networks with different component values. The graph in FIG. 7 is a beamwidth plot for an 16-element array of one meter high with two different sets of component values to derive a narrow pattern and a wide pattern. The graph illustrates the comparison between a coverage of 15 degrees (above 5 kHz) versus 40 degrees (above 800 Hz). FIG. 7 shows how the beamwidth may be varied by adjusting the component values of the passive components in the ladder delay network.

It is noted that the beamwidth plots of the 16-element array in FIG. 7 are identical below 1 kHz. This is because below 1 kHz, the coverage is defined by the height of the array, which in this case is one meter.

It is also noted that FIGS. 6-7 illustrate performance of vertically-oriented arrays. The loudspeaker arrays may also be oriented horizontally. The term 'beamwidth' refers to a width in the direction of the array configuration.

Figure 8:
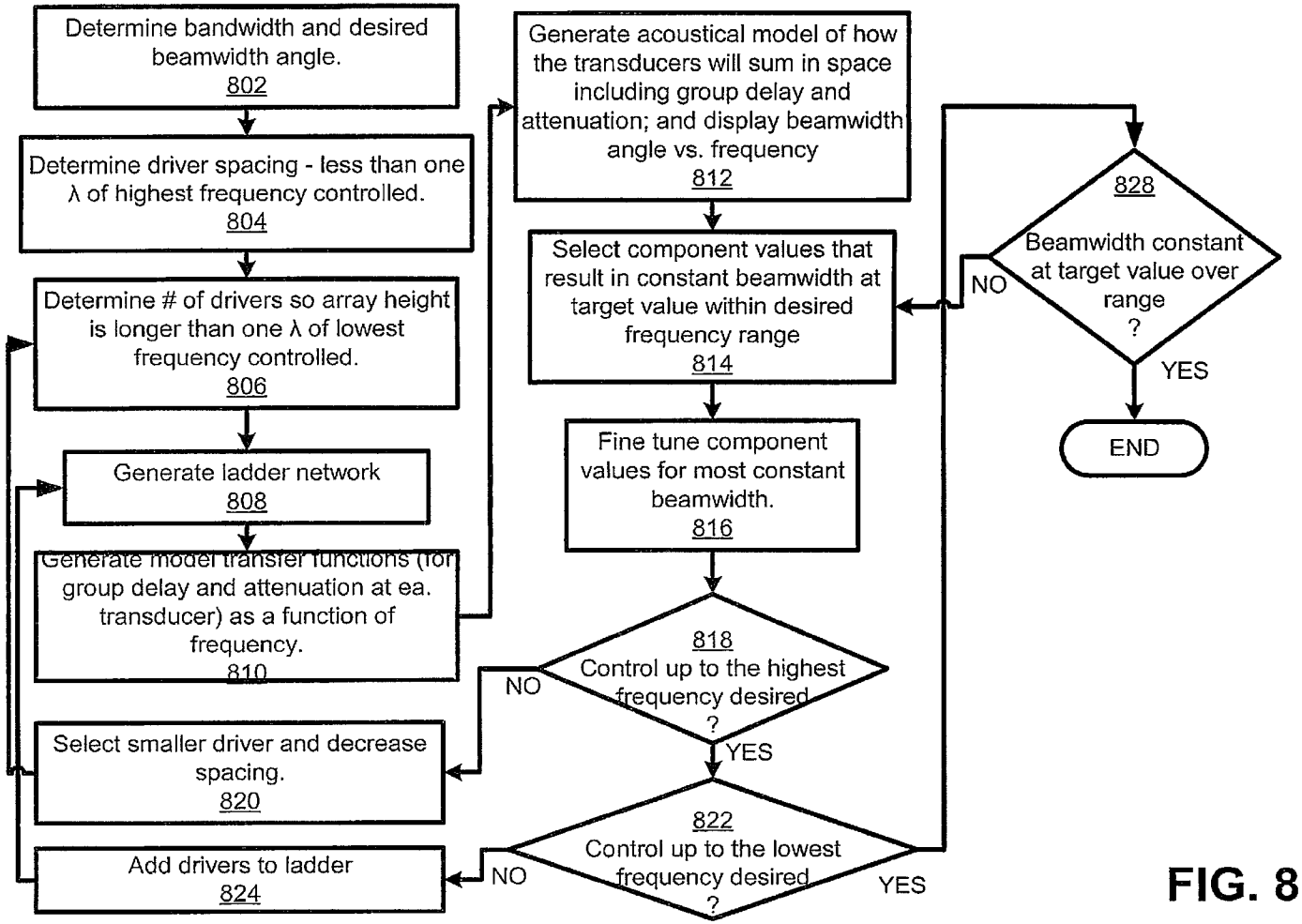
FIG. 8 is a flowchart depicting operation of an example of a method for providing an arc coverage pattern using a linear loudspeaker array.

FIG. 8 is a flowchart depicting operation of an example of a method for providing an arc coverage pattern using a linear loudspeaker array. The method illustrated in FIG. 8 may be implemented using a computer program having a user interface that permits user interaction for setting component values, loudspeaker positions, configuring views for data analysis, and setting any other parameter. The computer program may be developed as an application using a suitable programming language, or may be implemented as a macro or a sequence of instructions in an application such as a spreadsheet, a database, or suitable alternatives. The example method illustrated in FIG. 8 allows a user to determine component values for use in a selected network to create an arc coverage pattern with a linearly arranged loudspeaker array. The method also allows the user to optimize performance of the network by ensuring that a constant beam width is achieved at a desired level over the desired frequency range.

At step 802 in FIG. 8, the desired beamwidth and the desired bandwidth are determined. The beamwidth and bandwidth specifications may be entered into memory, or may be requested from the user via a user interface query. The user interface query may be a menu-driven interface, an electronic form, or any suitable alternative form of data entry.

At step 804, the driver spacing is determined. The spacing is the distance between the drivers. The driver spacing may be provided in memory or requested from the user via a user interface. In general, the driver spacing should be less than one wavelength (λ) of the highest frequency being controlled.

At step 806, the number of drivers to be used in the linear array is determined. driver spacing is determined. The number of drivers may be provided in memory or requested from the user via a user interface. In general, the number of drivers should be selected so that the height of the linear array is longer than one wavelength (λ) of the lowest frequency being controlled.

At step 808, a ladder network is generated. The ladder network may be defined by the topology of the stages, the components and component values. The configuration of each stage may be pre-defined in memory and offered to the user as alternatives from which to choose.

At step 810, a model transfer function is generated for the group delay or the attenuation at each transducer. The group delay or attenuation is generated as a function of frequency. The transfer function may be generated as a graph, but may be any user readable output. An example of a generated transfer function is shown at FIG. 4.

At step 812, an acoustical model illustrating how the transducers will sum in space is generated. The model includes the group delay or attenuation, and may be displayed as beamwidth vs. the frequency. FIGS. 6 and 7 depict examples of an acoustical model that may be generated to illustrate the beamwidth.

At step 814, the component values of the components in the stages of the ladder network may be adjusted to obtain a constant beamwidth over the desired frequency range. The component values may be selected from a broad range of values for each component. The values are selected to provide a near constant beamwidth at the desired frequency range. An initial set of values are selected for optimization by further fine tuning of the values. At step 816, the component values are fine-tuned for the most constant beamwidth. Step 816 performs a local search. A computational optimizer may be used in step 816 to fine tune the values until values are found that result in the most constant beamwidth at the target value over the required range. Optimizers have an initial condition (or a seed), and will find the local minima, maxima, or fixed values. The computational optimizer may use the component values found in step 814 as a seed.

At decision block 818, the acoustical model is checked to determine if it controls up to the highest frequency. If it does not ("No" branch), a smaller driver and driver spacing are selected at step 820 and the method goes back to step 806. If control up to the highest frequency is attained ("Yes" branch), the acoustical model is checked to determine if it controls down to the lowest frequency at decision block 822. If it is not ("No" branch), additional drivers are added to the ladder network at step 824. The method then continues to step 808 to generate a new ladder network. If control to the lowest frequency is attained at decision block 822 ("Yes" branch), the beamwidth is checked over the entire range at the target value. If the beamwidth is not constant ("No" branch), new seed component values are selected at step 814. If the beamwidth is constant ("Yes" branch), the design is complete.

While examples of implementations have been described above, various modifications may be implemented in other configurations. For example, a variable pattern control can be achieved using ganged switches that change the value of the components at the same time. The sound pattern may also be made to steer up or down if each half (for example, the top half and the bottom half) is driven with different ladder networks. A wider pattern coverage may also be achieved by adding physical curving of the array, so the array is not perfectly straight. The additional curving could be applied to only one half or to both asymmetrically. In the described implementations, the center drivers received the signal without a delay. In another implementation, a ground plane version may be created by providing the ladder delay from one end to the other of the array and positioning the non-delayed end perpendicular to a boundary.

The foregoing description of an implementation has been presented for purposes of illustration and description. It is not exhaustive and does not limit the claimed inventions to the precise form disclosed. Modifications and variations are possible in light of the above description or may be acquired from practicing the invention. For example, the described implementation includes software that optimizes the component values but the invention may be implemented as a combination of hardware and software or in hardware alone. Note also that the implementation may vary between systems. The claims and their equivalents define the scope of the invention.

What is claimed is:

1. A network of electronic components having an audio input and a plurality of audio outputs, the network comprising:

a plurality of stages, each stage having a stage input and a stage output, the stage output of each stage being coupled to the stage input of a next stage and to at least one of a plurality of loudspeakers;

each stage being configured to add an electrical delay to each subsequent stage via at least one passive component, the electrical delay being adjusted such that the plurality of loudspeakers generate sound in a desired radiation pattern; and the plurality of loudspeakers being arranged linearly, the plurality of loudspeakers including:

at least one middle loudspeaker connected in parallel to a first stage input, the at least one middle loudspeaker positioned at a center of the linear arrangement of loudspeakers, and at least one pair of loudspeakers, each pair connected in parallel to each stage output, the pair of loudspeakers positioned on opposite sides of the at least one middle loudspeaker, each loudspeaker in the pair of loudspeakers being positioned equidistant to the center of the linear arrangement.

2. The network of electronic components of claim 1 where each stage includes at least one passive component having component values selected to adjust the electrical delay.

3. The network of electric components of claim 2 where each stage includes an LC branch where at least one inductor is in series with the stage input and the stage output, and at least one capacitor is connected to the stage output in parallel with the at least one loudspeaker.

4. The network of electronic components of claim 3 where an inductance of the at least one inductor increases as a distance of the at least one loudspeaker to which the stage output is connected from a center loudspeaker in the plurality of loudspeakers increases.

5. The network of electronic components of claim 1 where each stage consists of at least one passive component having component values selected to provide a relatively flat attenuation over a broad frequency range.

6. The network of electric components of claim 1 where the plurality of loudspeakers includes a pair of loudspeakers connected to each stage output.

7. A loudspeaker array comprising:

a plurality of loudspeakers;

a delay network having a plurality of stages, each stage having a stage input and a stage output, the stage output of each stage being coupled to the stage input of a next stage and to at least one of the plurality of loudspeakers, the stage input of a first stage being coupled to an audio signal input, where each stage includes an LC branch where at least one inductor is in series with the stage input and the stage output, and at least one capacitor is connected to the stage output in parallel with the at least one of the plurality of loudspeakers; and each stage being configured to add an electrical delay to each subsequent stage, the electrical delay being adjusted such that the plurality of loudspeakers generate sound in a desired radiation pattern.

8. The loudspeaker array of claim 7 where the plurality of loudspeakers is arranged in a linear array having at least one middle loudspeaker positioned in a center of the linear array and a plurality of pairs of loudspeakers, each loudspeaker in the pairs of loudspeakers positioned opposite the other loudspeaker in the pairs of loudspeakers equidistant to the center of the linear array.

9. The loudspeaker array of claim 8 where the at least one middle loudspeaker is coupled to the audio signal input, and each loudspeaker pair is coupled to a stage output.

10. The loudspeaker array of claim 8 where the at least one middle loudspeaker includes a middle loudspeaker pair positioned opposite and equidistant to the center of the linear array.

11. The loudspeaker array of claim 10 where the middle loudspeaker pair is coupled to the audio signal input, and each loudspeaker pair is coupled to a stage output.

12. The loudspeaker array of claim 7 where component values for the LC branch of each stage are selected to adjust the electrical delay.

13. The loudspeaker array of claim 7 where component values for the LC branch of each stage are selected to provide a relatively flat attenuation over a broad frequency range.

14. The loudspeaker array of claim 7 where the stage output of each stage is connected to one or more loudspeakers having a same distance from one or more center loudspeakers, and wherein an inductance of the at least one inductor of each stage increases as the distance of the one or more loudspeakers connected to the stage output of that stage from the one or more center loudspeakers increases.

* * * * *